United States Patent [19]

Asplund et al.

[11] 4,030,969

[45] June 21, 1977

[54] METHOD OF DISPERSING A BLEACHING AGENT INTO A STREAM OF FIBROUS CELLULOSIC PULP MATERIAL IN A THROTTLING NOZZLE

[75] Inventors: Arne Johan Arthur Asplund; Rolf Bertil Reinhall, both of Lidingo; Per Johan Ingemar Ahrel, Frovi, all of Sweden

[73] Assignee: Defibrator AB, Stockholm, Sweden

[22] Filed: Jan. 20, 1975

[21] Appl. No.: 542,221

Related U.S. Application Data

[63] Continuation-in-part of Ser. No. 369,298, June 12, 1973, abandoned.

[30] Foreign Application Priority Data

June 13, 1972 Sweden ..... 7776/72

[52] U.S. Cl. ..... 162/23; 162/24; 162/68; 162/71; 162/78; 162/83; 241/17; 241/18; 241/28

[51] Int. Cl.[2] ..... D21B 1/12; D21C 9/10

[58] Field of Search ..... 162/23, 24, 26, 68, 162/21, 22, 71, 78, 83, 84; 241/1, 15, 17, 18, 23, 28

[56] References Cited

UNITED STATES PATENTS

| | | | |
|---|---|---|---|
| 2,422,522 | 6/1947 | Beveridge et al. | 162/24 X |
| 2,717,195 | 9/1955 | Armstrong | 162/24 X |
| 3,388,037 | 6/1968 | Asplund et al. | 162/23 |
| 3,467,574 | 9/1969 | West | 162/24 |
| 3,644,170 | 2/1972 | Mekata et al. | 162/23 X |

FOREIGN PATENTS OR APPLICATIONS

| | | | |
|---|---|---|---|
| 496,671 | 10/1953 | Canada | 162/23 |

*Primary Examiner*—Arthur L. Corbin
*Attorney, Agent, or Firm*—Eric Y. Munson

[57] ABSTRACT

A stream of disintegrated fibrous cellulosic pulp material and steam under pressure is subjected to an instantaneous pressure reduction as said stream and steam pass through a throttling nozzle, in a throttling zone, wherein a liquid solution of a bleaching agent is admixed with said stream and which stream, admixed with bleaching agent, is then passed into an expansion zone ahead of the throttling nozzle resulting in a uniform dispersion of the bleaching agent into the fibers in the stream of fibrous cellulosic pulp material.

2 Claims, 2 Drawing Figures

METHOD OF DISPERSING A BLEACHING AGENT INTO A STREAM OF FIBROUS CELLULOSIC PULP MATERIAL IN A THROTTLING NOZZLE

BACKGROUND OF THE INVENTION

This is a continuation-in-part of our co-pending application Ser. No. 369,298, filed June 12, 1973, which application is abandoned upon the filing of this application.

It is generally known in the art to use as bleaching agents or brightening agents for high yield fiber pulps for papermaking, certain oxidizing or reducing agents. Among such agents which, when added to the fiber pulp, increase the brightness of the paper, are different kinds of peroxides, as well as various salts, for example, salts of sulfurous acid, sulfite and bisulfite, and hydrosulfites. These bleaching agents are relatively expensive, and it is generally known that the efficiency and the degree of their utilization is increased considerably if the bleaching process is carried out with pulps of higher concentration of solids, i.e. with less water in the aqueous pulp suspension. In order to attain this favorable effect without having to overdose the chemicals due to dispersion problems, it is essential that the chemicals which are added to the high-consistency pulp are rapidly and uniformly dispersed over each individual fiber contained in the pulp suspension. For this purpose, mixing apparatus such as rapidly rotating disc refiners have heretofore been used, into which refiners the chemicals are introduced either before or during the passage of the pulp suspension through refiners or mixing discs.

In addition to disc refiners, a number of various constructions of so-called mixers have been used, which comprise arms which rotate at suitable speeds to agitate the high consistency fiber pulp. Common for these mixing apparatuses, however, is the fact that the purely mechanical treatment causing the dispersion and distribution of the added chemicals also acts in a mechanical way on the fibers contained in the pulp suspension and thereby produces changes in the so-called ground state of the fibers which may be less desirable in some situations.

Furthermore, the power required for the mechanical admixing process is high, although, in spite thereof, the efficiency of the admixing action is relatively low. Therefore, it has been necessary when using earlier known apparatus to overdose the quantity of added chemicals in order thereby to compensate for the lack of instantaneous effect of the intermixing action.

SUMMARY OF THE INVENTION

Among the objects of the invention is to provide a method for admixing the bleaching chemicals referred to herein, namely peroxides, sulfurous acid and its salts, such as sulfites, bisulphites and hydrosulfites, with the fiber pulp, which ensures excellent dispersion of the chemicals in the pulp in spite of the high concentration of solids in the pulp suspension.

A further object of the invention is to provide a method of increasing the whiteness of a pulp of cellulose fibers by means of bleaching agents admixed in a quantity just sufficient for obtaining the desired degree of whiteness irrespective of the concentration of fibers in the fiber suspension.

Still another object of the invention is to provide a method for admixing the aforesaid bleaching chemicals with highly concentrated cellulose fiber pulp suspensions without any overdosing of admixed chemicals.

Figure 1:
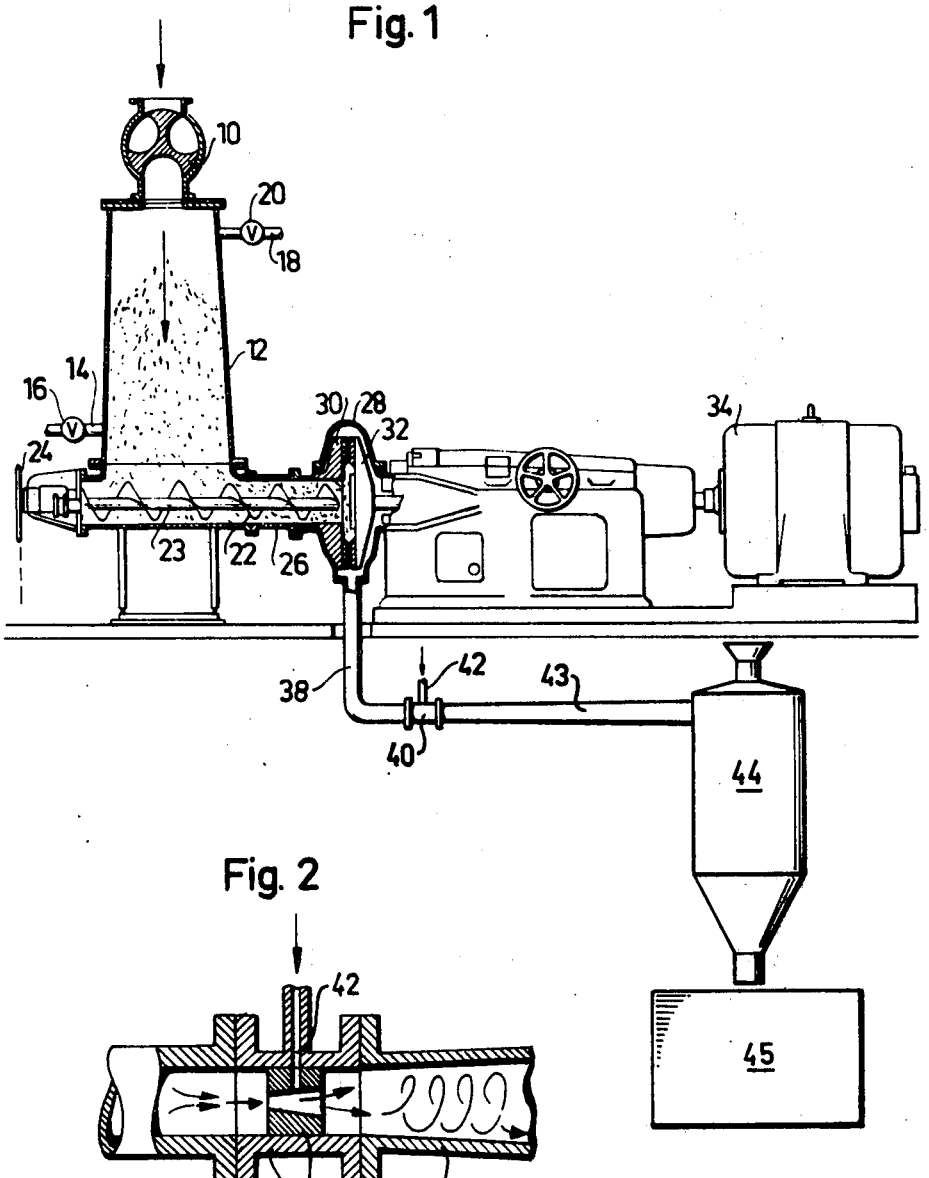
FIG. 1 is a lateral and partly vertical sectional view of a preferred device for carrying out the method according to the invention in combination with a pressurized refiner.
Figure 2:
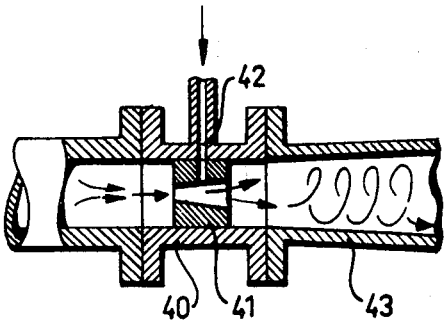
FIG. 2 is a sectional view on a larger scale of a throttling zone.

DETAILED DESCRIPTION OF A PREFERRED APPARATUS FOR CARRYING OUT THE METHOD OF THE INVENTION

The apparatus for carrying out the method according to the invention includes a pressurized refiner which according to the well-known Difibrator method operates under superatmospheric steam pressure and in which the separation of the fibers is effected at temperatures exceeding 100° C, at which temperatures the central lamella, which contains lignocellulose and keeps the fibers together, is softened and plasticised in a progressively increasing degree in response to the rising temperature. In this process, separation of the fibers can be effected with considerable saving of power, while at the same time the individual fiber can be separated without becoming damaged. This method of pulp production thus requires specially constructed apparatus, i.e. a disc refiner operated under superatmospheric pressure.

Fiberous material, e.g. in the shape of chips, to be disintegrated in one or several defibration steps is introduced through a sluice or so-called cell-feeder 10 into a preheater 12. This preheater is supplied with steam through a pipe 14 which is controlled by a valve 16. The preheater may have an outlet 18 controlled by a valve 20, for consumed steam escaping from the ground material. The pulp descends in the preheater and during this movement is heated rapidly to the desired treating temperature e.g. between 120° and 170° C depending on the temperature and pressure of the steam. Provided at the bottom of the preheater 12 is a helical feeder 22 which is driven by a sprocket 24 from a motor not shown and which conveys the preheated pulp through a channel 26 to a refiner 28 provided with two-grinding discs 30, 32 of a type known per se. The refiner may be of the type shown and described in the U.S. Pat. No. 2,891,733. The grinding disc 32 is driven by a motor 34.

The ground fibrous cellulosic pulp material is discharged through a duct 38, in which is provided a throttling zone 40, embodying the main feature of the invention. In the refiner 28 the same pressure prevails as in the preheater 12, but in connection with the passage of the fibrous cellulosic pulp material through the throttling zone 40 an instantaneous reduction of pressure is produced.

This reduction of pressure in the throttling zone 40 causes a very violent turbulence in the subsequent pipe duct. This phenomenon known per se is utilized according to the present invention for effectively admixing and intermixing the bleaching chemicals with the fiber pulp produced in the pressurized refiner.

In the illustrated embodiment, the throttling zone 40 is provided with a stationary throttling nozzle 41 through which the fiber pulp is blown out into an attached conveyor duct or expansion zone 43 which opens into a receiving centri-cleaner 44 where steam accompanying the fiber suspension is separated out. The separated fiber pulp is discharged from the lower end of the centricleaner into a storage bin 45 where the fibers with or without addition of water are retained for a predetermined period of time for final reaction with the chemicals admixed in the throttling zone 40.

The throttling nozzle 41 is provided with one or more radial inlet channels 42 through which the bleaching chemicals in liquid state, such as in aqueous solution, are aded so as to produce an adequate flow of fibrous cellulosic pulp material carried by the steam and passing through the throttling nozzle.

The fibrous pulp discharged from the pressurized refiner into the throttling zone usually has a concentration of between 40 and and 70 percent. During its passage through the throttling nozzle, the pulp instantaneously passes from the relatively high pressure maintained in the pressurized refiner to a substantially lower pressure in the section behind the throttling nozzle. The steam accompanying the pulp is thereby subjected to an adiabatic expansion with consequent reduction of temperature, whereas at the same time a portion in the moisture of the entrained fibers is transformed into vapor state.

Thus, the discharged fiber pulp during its passage through the throttling zone 40 and the throttling nozzle 41 thereof is subjected to partial drying to a still higher degree of concentration. The expansion of the steam causes a very severe turbulence in the following discharge duct 43. This turbulence is also imparted to the fiber particles accompanying the steam with the result that during the passage of the fibrous particles from the throttling nozzle 41 through the discharge duct 43 to the receiving centri-cleaner 44, the solution of the bleaching chemicals supplied through the channels 42 is intimately mixed with and dispersed into the individual fibers. By this arrangement for intermixing of the chemicals, the following advantages are obtained: (1) The admixture and intermixture can be effected with pulp concentrations at a substantially higher level than has been heretofore possible with previously known mechanical intermixing apparatus without causing damage to the fibers. (2) Due to the fact that fibrous particles having a bone dry content exceeding even 50 percent can effectively be treated with bleaching chemicals, these chemicals are allowed to react with the external surface of the fibers without any appreciable dilution by the water accompanying the fibrous particles.

MODIFICATIONS OF THE ILLUSTRATED DEVICE

The throttling zone may be provided with an adjustable throttling nozzle having the shape of a cock, a ball valve or some other means to control the area of passage. The bleaching chemicals may be added immediately ahead of the throttling zone 40 or behind the same within the region where turbulence is imparted to the fibers. Furthermore, additional working machines, by means of which the fiber suspension is imparted desired properties, may be interposed between the throttling zone 40 and the receiving centri-cleaner 44.

While one more or less specific embodiment of the device for carrying out the method of the invention and thus a specific embodiment of said method have been shown and described, it is to be understood that this is for the purpose of illustration only, and that the invention is not to be limited thereby, but its scope is to be determined by the appended claims.

What is claimed is:

1. A method of admixing and dispersing a liquid solution of a bleaching agent into a stream of fibrous cellulosic pulp material comprising:

a. disintegrating fibrous cellulosic material in a defibrating zone in an atmosphere of steam above 100° C and at superatmospheric pressure to form a fibrous cellulosic pulp material;

b. passing a stream of the fibrous cellulosic pulp material together with the steam under pressure into a throttling zone of reducing pressure;

c. subjecting said stream and steam to an instantaneous reduction of pressure by passing said stream and steam through a throttling nozzle in said throttling zone;

d. introducing a liquid solution of the bleaching agent into said stream as said stream passes through said nozzle;

e. discharging said stream and bleaching solution into an expansion zone ahead of said throttling nozzle to enhance dispersion of the bleaching agent into the fibrous cellulosic pulp material; and then f. passing the fibrous cellulosic pulp material to a collection zone.

2. The method as claimed in claim 1, wherein a portion of moisture in the stream of fibrous cellulosic pulp material is transformed to vapor upon the stream passing through the throttling nozzle thereby partially drying the pulp material to a higher solids concentration thus permitting chemical action of the bleaching agent with the pulp material without appreciable dilution of the pulp material by water accompanying said pulp material.

* * * * *